US007374021B2

(12) United States Patent
Martí et al.

(10) Patent No.: US 7,374,021 B2
(45) Date of Patent: May 20, 2008

(54) COMBINED ELEVATOR GUIDING AND SAFETY BRAKING DEVICE

(75) Inventors: Luis Martí, Madrid (ES); Mikel Azurza, San Sebastián (ES)

(73) Assignee: Otis Elevator Company, Farmington, CT (US)

( * ) Notice: Subject to any disclaimer, the term of this patent is extended or adjusted under 35 U.S.C. 154(b) by 399 days.

(21) Appl. No.: 10/529,079

(22) PCT Filed: Oct. 9, 2002

(86) PCT No.: PCT/US02/32250

§ 371 (c)(1),
(2), (4) Date: Mar. 24, 2005

(87) PCT Pub. No.: WO2004/033353

PCT Pub. Date: Apr. 22, 2004

(65) Prior Publication Data

US 2005/0241886 A1 Nov. 3, 2005

(51) Int. Cl.
*B66B 5/18* (2006.01)
*B66B 7/04* (2006.01)

(52) U.S. Cl. ..... 187/370; 187/375; 187/288

(58) Field of Classification Search ..... 187/287, 187/288, 370, 366, 375, 379
See application file for complete search history.

(56) References Cited

U.S. PATENT DOCUMENTS 5,033,587 A * 7/1991 Nakai et al. ..... 187/289
5,224,570 A 7/1993 Fromberg
5,377,786 A 1/1995 Nakagawa
5,439,075 A * 8/1995 Skalski et al. ..... 187/410
6,092,630 A 7/2000 Wendel et al.
6,176,350 B1 1/2001 Schlosser
6,758,310 B2 * 7/2004 Muff et al. ..... 187/370
2004/0112683 A1 * 6/2004 Liebetrau et al. ..... 187/372

FOREIGN PATENT DOCUMENTS

JP 05132263 A * 5/1993

OTHER PUBLICATIONS

PCT International Search Report, Nov. 25, 2002.
PCT International Preliminary Examination Report for International Application No. PCT/US02/32250 filed Oct. 9, 2002.

* cited by examiner

*Primary Examiner*—Lincoln Donovan
*Assistant Examiner*—Eduardo Colon

(57) ABSTRACT

A combined elevator guiding and braking device (30) includes movable members (34) positioned symmetrically about opposite sides of guide rail (24). Guide members (40) are supported on the movable members (34) for following along the guide rail (24) under normal elevator system operation. When a safety braking function is required, braking members (44) engage the surfaces on the guide rail (24) when the movable members (34) move into a second operating position to achieve the braking function. The inventive arrangement integrates the car guiding and safety braking functions into a single device.

27 Claims, 3 Drawing Sheets

COMBINED ELEVATOR GUIDING AND SAFETY BRAKING DEVICE

TECHNICAL FIELD

This invention generally relates to elevator systems. More particularly, this invention relates to a combined guiding and braking device for use in an elevator system.

THE PRIOR ART

Elevator systems typically include a car that moves within a hoistway between different levels in a building. Guide rails within the hoistway provide structure for guiding movement of the car as needed. Typical systems include guide rollers or guide shoes that ride along surfaces on the guide rails to facilitate movement of the car.

Typical elevator systems also include a safety braking device for stopping device for stopping movement of the car under certain conditions. Typical safety devices include brakes that engage one or more surfaces on a guide rail to prevent movement of the car along the guide rail.

While the guide system and the safety braking system perform different functions, their operation has some interdependence in most situations. Typical rail guide systems have some influence on the working and performance of the safety devices. Depending on the particular design of the safety device, some arrangements are susceptible to an improper alignment between the safety device and the guide shoes. Such misalignment may produce noise, wear in the safety device, nuisance trippings and possible degradation of the safety device performance. Many guide shoes are flexible to provide proper ride comfort and this amplifies any misalignment problem.

Another difficulty associated with conventional arrangements is that the combination of the rail clearance and the guide shoe stiffness may not allow proper safety device operation. This typically occurs for safety devices that do not have symmetrical operation but can also be problematic with symmetrical arrangements. If this is the case, the performance of the safety device may be compromised. One attempt at addressing this problem is to utilize non-symmetrical safety devices with a flexible mounting for the safety gear, allowing it to move horizontally relative to the guide rail. Such arrangements, however, typically require a relatively large and expensive interface between the safety gear and the elevator car frame.

It is desirable to reduce the size and complexity of elevator safety devices. One limitation on attempts to achieve this end is that the guide shoe contact surface cannot be used as a braking surface for the safety device function. Normal wear on the guiding surface may degrade the performance of the safety device in the event that the safety device were activated. Some elevator codes do not allow such double use of a guide shoe surface.

Those skilled in the art are always striving to simplify and reduce the weight and size of elevator safety systems while simultaneously improving their performance. This invention accomplishes that goal while avoiding the shortcomings and drawbacks of the prior art.

SUMMARY OF THE INVENTION

In general terms, this invention is a combined elevator car guiding and safety braking device. Both functions are integrated into a single device that operates in two different modes; one for guiding the elevator car during movement and a second for stopping the elevator car when the safety device is engaged.

An example elevator car guiding and braking device designed according to this invention includes a base member adapted to be supported for movement with the elevator car. A movable member is supported on the base member to be selectively movable relative to the base member. A guiding member is supported on the movable member such that the guiding member is movable along a guide rail when the movable member is in a first operating position. A braking member also is supported on the movable member such that the braking member can engage the guide rail when the movable member moves into a second operating position.

In one example, the movable member is a lever that is pivotally supported to pivot relative to the base member between the first and second positions. The guiding member guides movement of the elevator car along the guide rail when the movable member is in the first position. When safety braking is required, the movable member pivots relative to the base member so that the braking member engages the appropriate guide rail surface. The currently preferred arrangement is symmetrical and includes two movable members, one on each side of a guide rail so that two guiding members contact the guide rail during normal elevator movement and two braking members contact the guide rail when the safety device is activated.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
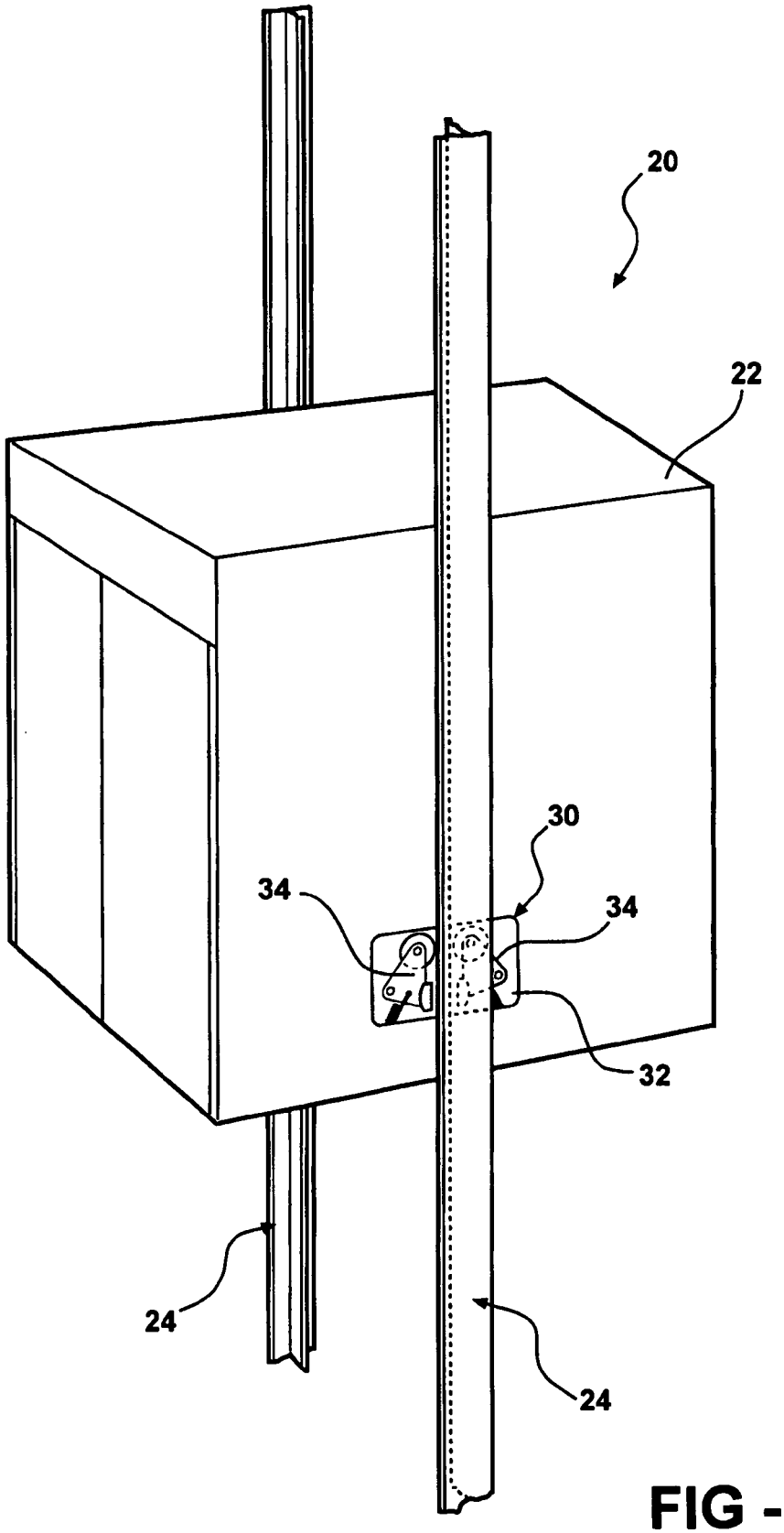
FIG. 1 schematically illustrates selected portions of an elevator system including a guiding and safety braking device designed according to this invention.

FIG. 1 schematically illustrates selected portions of an elevator system 20 that is designed according to this invention. An elevator car 22 moves along guide rails 24 in a conventional manner to move within a hoistway between different levels within a building, for example. The inventive system includes a combined guiding and safety braking device 30 that is supported for movement with the elevator car 22 in the hoistway.

The illustrated example schematically shows one combined guiding and braking device 30 supported on the elevator car 22. A similar device preferably is supported on an opposite side of the elevator car 22 so that a guiding and braking device 30 is associated with each of the guide rails 24. Further, it is within the scope of this invention to support the guiding and braking device 30 on framing associated with the elevator car in a variety of positions or orientations provided that the appropriate contact with the guide rail surfaces are achieved. Those skilled in the art who have the benefit of this description will realize the best way to incorporate a guiding and braking device designed according to this invention into an elevator system to meet the needs of their particular situation.

Figure 2:
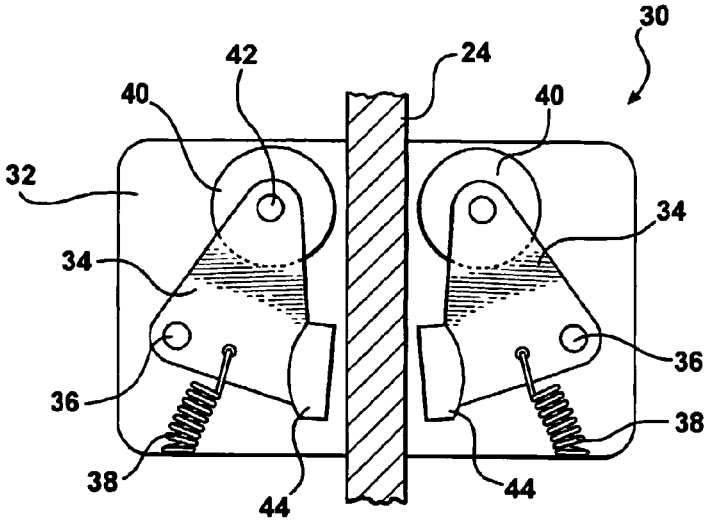
FIG. 2 schematically illustrates a first example guiding and safety braking device designed according to this invention.

FIG. 2 schematically illustrates one example combined guiding and braking device 30 designed according to this invention. A base member 32 supports two movable members 34 that are pivotally supported on posts 36 that are secured to the base 32 in a conventional manner. In the illustrated example, the movable members 34 comprise levers that are biased into a first operating position shown in FIG. 2 by biasing members 38. The illustrated example includes coil springs as the biasing members 38.

When the movable members 34 are in the first operating position, guide members 40 are positioned to engage appropriate surfaces on the guide rail 24. In the illustrated example of FIG. 2, the guide members 40 comprise rollers that rotate about axes 42 relative to the movable members 34. In another example, the guide members 40 comprise guide shoes. During normal elevator operation, the guide members 40 follow along the guide rail 24 surfaces to facilitate movement of the car 22 within the hoistway.

Figure 3:
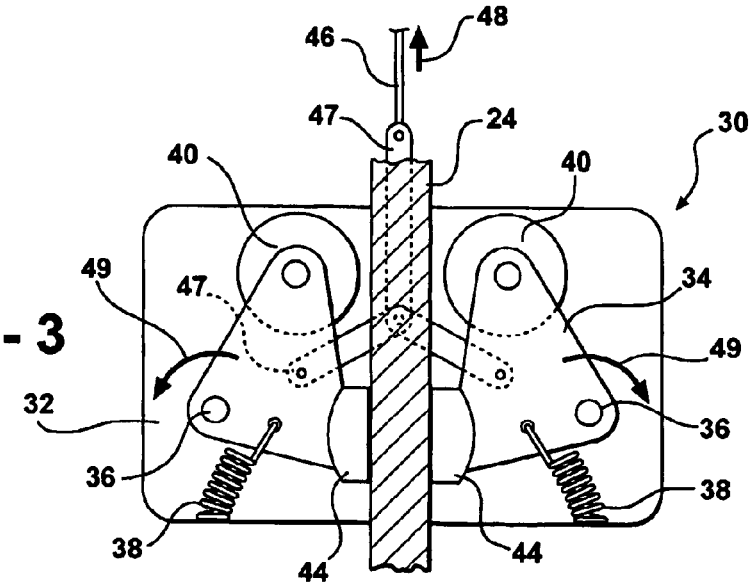
FIG. 3 schematically illustrates the embodiment of FIG. 2 in a second operation position.

The movable members 34 also support braking members 44 that are adapted to engage the guide rail 24 surfaces when safety braking is required. FIG. 3 schematically illustrates the first example device in a second operating condition where the movable members 34 have moved to a second position. The illustrated example includes a governor rope 46 and linkage 47 (shown in FIG. 3 only) for triggering the safety function of the device 30. Responsive to a force schematically shown at 48 on the governor rope 46 and the linkage 47, the movable members 34 are pivoted about the posts 36 as shown by the arrows 49.

In this second operating position, the guide members 40 are removed from contact with the guide rail 24 and the braking members 44 are moved into operative contact with the appropriate surfaces on the guide rail 24. The triggering action of the force on the governor rope 46 overcomes the bias of the springs 38 to move the movable member 34 into the second operating position where the safety braking function brings the elevator car 22 to a stop as needed.

The movable members 34 preferably are operated associated with each other with an appropriate linking mechanism (47) so that simultaneous activation of the braking members 44 occurs. Known techniques for triggering a safety braking device using a governor rope are useable with the illustrated examples.

The two moving members 34 preferably are symmetrically arranged on both sides of the guide rail 24. The inventive arrangement allows for the guide members 40 to be in contact with the rail 24 during normal elevator system operation. In this same position, the braking members 44 are sufficiently clear of the guide rail 24 surfaces 50 that there is no interference from them until needed.

When the safety braking function is required, the movement of the movable members 34 removes the guide members 40 from contact with the guide rails 24 and moves the braking members 44 into contact with the guide rails 24. The inventive arrangement ensures that there is no interference between the functions of the guide members 40 and the braking members 44. Another advantage of the inventive arrangement is that it guarantees proper alignment of the safety braking components with the guide rail 24 because the guide members 40 and the braking members 44 are supported on a common rigid structure.

The example of FIGS. 2 and 3 includes a cam type braking member 44. Those skilled in the art understand that there are a variety of brake pad materials that are useful for such arrangements. Those skilled in the art who have the benefit of this description will be able to select appropriate materials to meet the needs of their particular situation.

Figure 4:
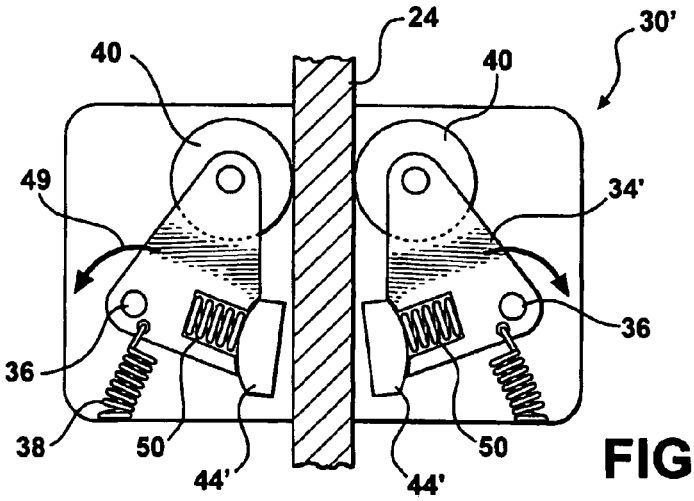
FIG. 4 schematically illustrates another example guiding and safety braking device designed according to this invention.

FIG. 4 shows another combined guiding and safety device 30' designed according to this invention. In this example, the braking members 44' are of the so-called progressive type. Biasing members 50, which in the illustrated example are coiled springs, urge the braking members 44' away from the moving members 34 in a manner understood in the art to achieve the desired braking function. The biasing members 50, however, do not urge the braking members 44' away from the movable members 34' in a manner that would cause the braking members 44' to engage the guide rail 24 while the guide members 40 are supposed to be guiding the elevator car 22 during normal system operation. A variety of known guide members and known braking members may be used in a system designed according to this invention.

Figure 5:
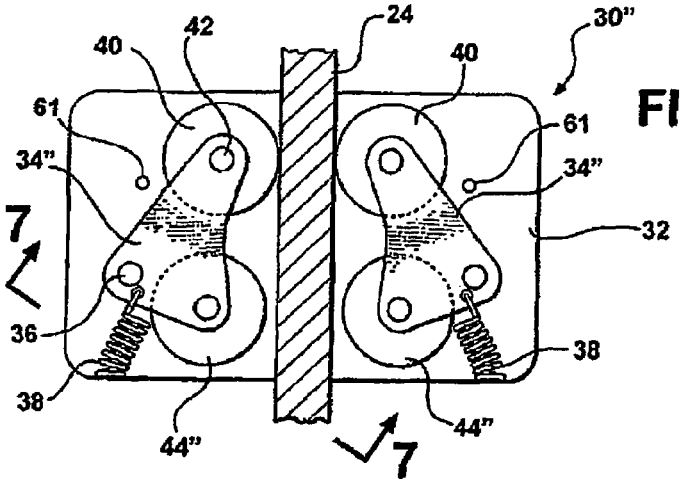
FIG. 5 schematically illustrates another example guiding and braking device designed according to this invention in a first operating position.

FIG. 5 illustrates another example combined guiding and safety braking device 30" designed according to this invention. This example includes a unique braking member 44" that operates in a manner that is different than conventional braking members. In this example, the movable members 34" comprise two arms 34*a*" and 34*b*" that are positioned on opposite sides of the roller braking member 44". The braking members 44" are supported so that they are capable of rotating relative to the movable members 34" and rolling along the guide rail surfaces.

Figure 7:
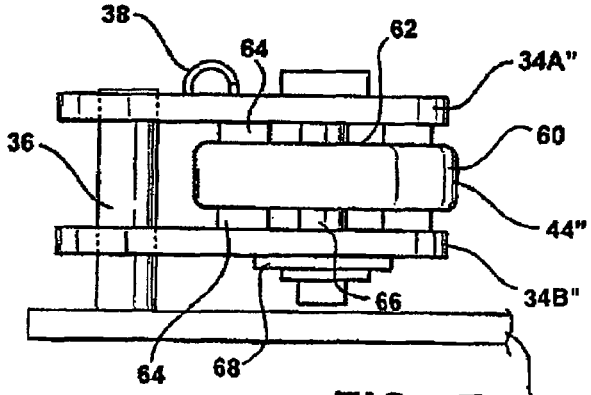
FIG. 7 is a view taken along the lines 7-7 in FIG. 5.

As best appreciated from FIG. 7, a guide rail contacting surface 60 on the rollers 44" in this example is made from a hardened metal and has a knurled surface. The braking members 44" are adapted to engage the appropriate surface on the guide rail 24 when the governor rope 46 (or other safety brake triggering mechanism) causes movement of the movable members 34" into the second operating position where the braking members 44" engage the guide rail surfaces. Stops, such as posts 61, are supported on the illustrated base 32 to limit movement of the members 34 beyond a desired second position.

Figure 6:
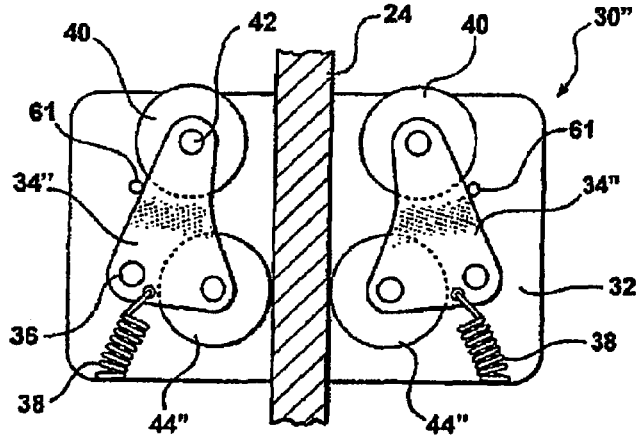
FIG. 6 schematically illustrates the embodiment of FIG. 5 in a second operating position.

The example arrangement of FIGS. 5-7 includes braking members supported by the movable members 34" for engaging side surfaces 62 on the rollers 44" to apply a braking force against the rollers but not directly against the guide rail. Brake pads 64 in the illustrated example are supported on the arms 34*a*" and 34*b*". The brake pads 64 engage the side surfaces 62 of the rollers 44" to resist rotation of the rollers and to provide the safety braking function.

This example arrangement has advantages because the potential for deforming or otherwise damaging the surfaces on the guide rail 24 along which the guide members 40 ride, is minimized or eliminated. Applying a braking force parallel to an axis of rotation (i.e., along a support 66) facilitates heat energy dissipation between the brake pads 64 and the roller 44" without requiring energy dissipation on the rails 24 themselves.

The illustrated example shows in FIG. 7 a biasing member 68 such as a Belleville washer that biases the arms 34*a*" and 34*b*" toward each other to maintain appropriate contact between the brake pads 64 and the side surfaces 62 of the rollers 44".

The inventive arrangement provides cost savings because it reduces the size, complexity and amount of components necessary to achieve the desired elevator car guidance and safety braking functions. The inventive arrangement facilitates easier system assembly and maintenance in addition to the cost-savings advantages just mentioned.

While several example devices designed according to this invention have been disclosed, other variations are possible that do not depart from the basis of this invention. Variations and modifications to the disclosed examples may become apparent to those skilled in the art that do not necessarily depart from the essence of this invention. The scope of legal protection given to this invention can only be determined by studying the following claims.

We claim:

1. A car guiding and braking device for use in an elevator system, comprising:

a base member adapted to be supported for movement with an elevator car;

a moveable member supported on the base member to be selectively moveable relative to the base member;

a guiding member supported on the moveable member such that the guiding member is configured to be in contact with and moveable along a guide rail when the moveable member is in a first operating position; and a braking member supported on the moveable member such that the braking member engages the guide rail when the moveable member moves into a second operating position.

2. The device of claim 1, including a biasing member that biases the moveable member into the first operating position.

3. The device of claim 1, wherein the moveable member comprises a lever that is pivotally supported to pivot relative to the base member between the first and second positions.

4. The device of claim 3, wherein the guiding member and the braking member are supported near opposite ends of the lever.

5. The device of claim 1, including two movable members each supporting a guiding member and a braking member and wherein the moveable members are positioned on the base member such that the braking members are adapted to engage oppositely facing surfaces on the guide rail when the moveable members move into the second position.

6. The device of claim 1, wherein the guiding member comprises a roller.

7. The device of claim 1, wherein the braking member comprises a brake shoe and including a biasing member that biases the brake shoe away from the moveable member.

8. The device of claim 1, wherein the braking member comprises a roller supported by the moveable member and a brake associated with the roller, an outer surface on the roller engaging the guide rail when the moveable member moves into the second position, the brake engaging a side surface on the roller to apply a braking force to resist rotation of the roller.

9. The device of claim 8, wherein the roller rail engaging surface comprises a hardened, knurled metal.

10. The device of claim 8, wherein the brake comprises at least one brake pad engaging a side surface on the braking roller, the brake pads applying a braking force in a direction that is parallel to an axis of rotation of the roller.

11. The device of claim 1, wherein the guiding member is spaced from the guide rail when the moveable member is in the second operating position.

12. An elevator system, comprising:

a car;

a guide rail that guides movement of the car;

at least two moveable members that are supported for movement with the car, that are positioned on opposite sides of a portion of the guide rail and that are moveable between first and second positions;

a guiding member supported on each moveable member such that the guiding member is configured to be in contact with and moveable along a surface of the guide rail to guide movement of the car when the moveable member is in the first position; and a braking member supported on each moveable member such that the braking member engages the guide rail surface to resist movement of the car when the moveable member moves into the second position.

13. The system of claim 12, including at least one biasing member that biases the moveable members into the first position.

14. The system of claim 12, wherein the moveable members comprise levers that are pivotally supported to pivot between the first and second positions.

15. The system of claim 14, wherein the guiding members and the braking members are supported near opposite ends of the corresponding levers.

16. The system of claim 12, wherein the guiding members (40) each comprise a roller.

17. The system of claim 12, wherein the braking members comprises a brake shoe and including a biasing member that biases each brake shoe away from the corresponding moveable member.

18. The system of claim 12, wherein the braking members each comprise a roller supported by the corresponding moveable member and a brake associated with each roller, an outer surface on each roller engaging the guide rail when the moveable members move into the second position, each brake engaging a side surface on the corresponding roller to apply a braking force to resist rotation of the roller.

19. The system of claim 18, wherein the roller rail engaging surface comprises a hardened, knurled metal.

20. The system of claim 18, wherein each brake comprises at least one brake pad engaging a side surface on the braking roller, the brake pads applying a braking force in a direction that is parallel to an axis of rotation of the roller.

21. The system of claim 12, including at least one stop member that prevents the moveable members from moving beyond the second position.

22. The system of claim 12, wherein each guiding member is spaced from the guide rail when the moveable member is in the second position.

23. A car guiding and braking device for use in an elevator system, comprising:

a base member adapted to be supported for movement with an elevator car;

a moveable member supported on the base member to be selectively moveable relative to the base member, the moveable member comprising a lever that is pivotably supported to pivot relative to the base member between first and second operating positions;

a guiding member supported on the moveable member such that the guiding member is moveable along a guide rail when the moveable member is in the first operating position; and a braking member supported on the moveable member such that the braking member engages the guide rail when the moveable member moves into the second operating position, the guiding member and the braking member being supported near opposite ends of the lever.

24. A car guiding and braking device for use in an elevator system, comprising:

a base member adapted to be supported for movement with an elevator car;

two moveable members supported on the base member to be selectively moveable relative to the base member;

a guiding member supported on each of the moveable members such that the guiding member is moveable along a guide rail when the moveable members are in a first operating position; and a braking member supported on each of the moveable members such that the braking member engages the guide rail when the moveable members move into a second operating position, the moveable members being positioned on the base member such that the braking members are adapted to engage oppositely facing surfaces on the guide rail when the moveable members move into the second position.

25. A car guiding and braking device for use in an elevator system, comprising:

a base member adapted to be supported for movement with an elevator car;

a moveable member supported on the base member to be selectively moveable relative to the base member;

a guiding member supported on the moveable member such that the guiding member is moveable along a guide rail when the moveable member is in a first operating position; and a braking member supported on the moveable member such that the braking member engages the guide rail when the moveable member moves into a second operating position, the braking member comprising a roller supported by the moveable member and a brake associated with the roller, an outer surface on the roller engaging the guide rail when the moveable member moves into the second position, the brake engaging a side surface on the roller to apply a braking force to resist rotation of the roller.

26. The device of claim 25, wherein the roller rail engaging surface comprises a hardened, knurled metal.

27. The device of claim 25, wherein the brake comprises at least one brake pad engaging a side surface on the braking roller, the brake pads applying a braking force in a direction that is parallel to an axis of rotation of the roller.

* * * * *